United States Patent [19]

Suwa

[11] 4,441,000

[45] Apr. 3, 1984

[54] SLIDE SWITCH MECHANISM

[75] Inventor: Kaname Suwa, Yokohama, Japan

[73] Assignee: Canon Kabushiki Kaisha, Tokyo, Japan

[21] Appl. No.: 352,021

[22] Filed: Feb. 24, 1982

[30] Foreign Application Priority Data

Mar. 6, 1981 [JP] Japan ..... 56-32113

[51] Int. Cl.[3] ..... H01H 9/00; H01H 15/00

[52] U.S. Cl. ..... 200/291; 200/16 R; 200/16 D; 200/323

[58] Field of Search ..... 200/291, 280, 292, 281, 200/252, 16 R, 16 A, 16 D, 260, 323-325; 74/527

[56] References Cited

U.S. PATENT DOCUMENTS

| | | | |
|---|---|---|---|
| 3,485,966 | 12/1969 | Bailey et al. | 200/291 X |
| 3,843,852 | 10/1974 | Lockard | 200/16 D |
| 4,057,520 | 11/1977 | Schwartz | 200/16 D |
| 4,152,565 | 5/1979 | Rose | 200/291 |
| 4,186,288 | 1/1980 | Overton et al. | 200/16 D X |
| 4,316,067 | 2/1982 | Whiteman, Jr. | 200/291 |
| 4,324,957 | 4/1982 | Josemans | 200/291 X |
| 4,341,935 | 7/1982 | Josemans | 200/252 |

FOREIGN PATENT DOCUMENTS

| | | | |
|---|---|---|---|
| 884009 | 7/1943 | France | 200/291 |

*Primary Examiner*—John W. Shepperd
*Assistant Examiner*—Ernest G. Cusick
*Attorney, Agent, or Firm*—Fitzpatrick, Cella, Harper & Scinto

[57] ABSTRACT

A slide switch mechanism having a guide member and a slide member slidable along the guide member, in which the mutually contacting faces of the members have projections or recesses for mutual positioning of the member. The slide member can also be assembled in a reversed manner in the guide member, and at least one of the faces coming into contact in such inverted assembly of the slide member has additional projections or recesses so that the slide member can have different positions from those in the normal assembly of the slide member.

6 Claims, 5 Drawing Figures

SLIDE SWITCH MECHANISM

BACKGROUND OF THE INVENTION

1. Field of the Invention

The present invention relates to a slide switch mechanism utilizing the outer casing of electronic appliances such as electronic calculators.

2. Description of the Prior Art

In electronic calculators and similar appliances, there is commonly employed a slide switch mechanism in which a switch knob member having a contactor element is slidably supported over internal contact patterns by the outer casing or the appliance and the internal printed circuit board. In such a switch mechanism, however, the switch knob member and the outer casing have to be newly prepared when the number of switch positions is changed, requiring expensive metal molds for casting anew.

SUMMARY OF THE INVENTION

The object of the present invention is to provide a slide switch mechanism capable of changing the switch stroke, switch positions etc. by the method of assembling.

Another object of the present invention is to provide a slide switch mechanism with a simplified structure.

Still another object of the present invention is to provide a slide switch mechanism which can be prepared with a reduced manufacturing cost.

Still another object of the present invention is to provide a slide switch mechanism allowing easier assembling.

Still other objects and advantages of the present invention will be made fully apparent from the following description of the preferred embodiments.

DESCRIPTION OF THE PREFERRED EMBODIMENTS

Figure 1:
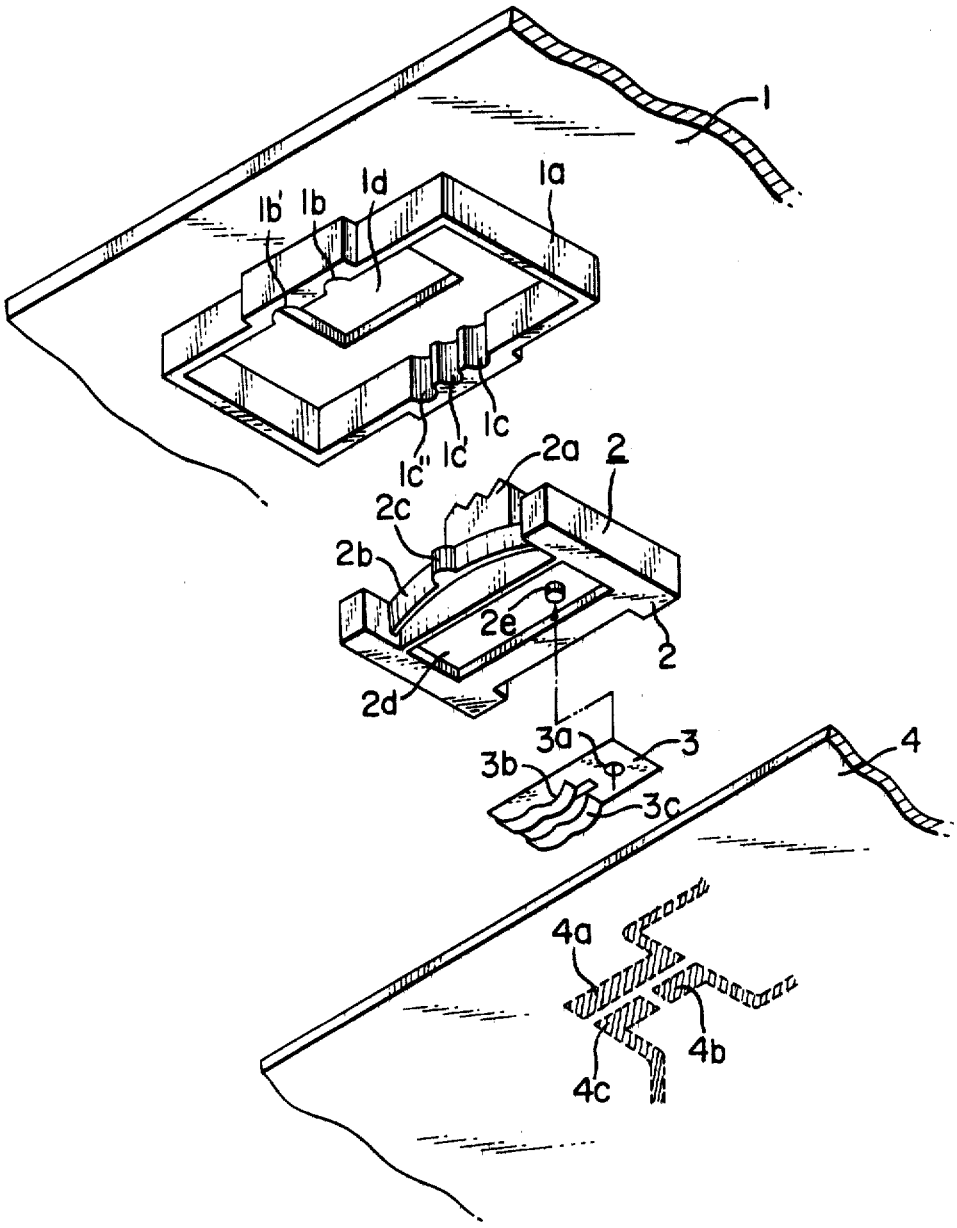
FIG. 1 is an exploded perspective view of a slide switch mechanism embodying the present invention.

FIG. 1 shows a slide switch mechanism embodying the present invention in an exploded perspective view, wherein an upper casing 1 for an electronic calculator injection molded from an ABS resin or the like is internally provided with guide walls 1*a* constituting a guide member and surrounding a slide member 2. Two mutually opposed walls are respectively provided with recesses 1*b*, 1*b*' for 2-position function and recesses 1*c*, 1*c*', 1*c*'' for 3-position function constituting a first engaging portion for engaging with a second engaging portion formed on the slide member 2. In the ceiling portion inside said guide walls 1*a* there is provided an aperture 1*d* for exposing a knob portion 2*a* of said slide member 2 to the exterior of the calculator, wherein said aperture 1*d* has a width slightly larger than that of said knob portion 2*a* and a length allowing a full stroke displacement of said slide member 2 inside said guide walls 1*a*. The slide member 2 is for example injection molded from a plastic material of a low friction coefficient such as Duracon and is provided thereon with the above-mentioned knob portion 2*a* having grooves on top for facilitating manipulation. Said slide member 2 is formed, at a side of the base portion thereof, as an arched spring 2*b* constituting said second engaging portion and provided at the center thereof with a semi-circular projection 2*c* for causing click feeling in the switch manipulation and determining the switch positions as will be explained later. The slide member 2 is further provided at the bottom face thereof with a seat 2*d* for an elastic metal contact electrode 3, wherein a positioning boss 2*e* is provided in said seat 2*d* so that the contact electrode 3 can be correctly mounted by engaging a positioning hole 3*a* thereof with said boss 2*e* as indicated by a double-dotted chain line. Said contact electrode 3 is divided into two strips and bent downwards at end portions 3*b*, 3*c* for contact with conductive circuit patterns 4*a*, 4*b*, 4*c* formed on the upper face of a printed circuit board 4.

Figure 2:
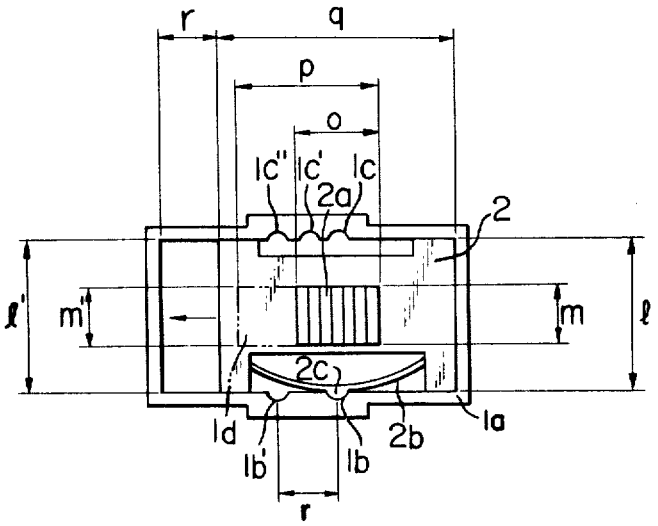
FIGS. 2 and 3 are plan views of an embodiment of the slide switch mechanism used respectively for 2- and 3-position functions.
Figure 3:
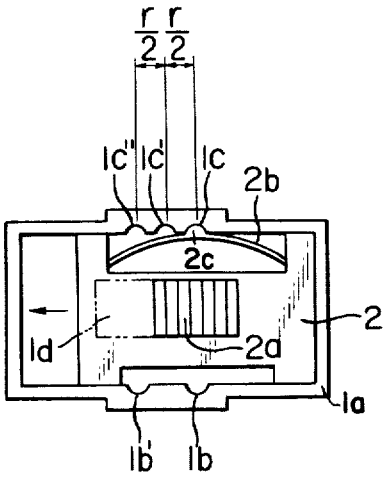

The slide switch mechanism explained above can be assembled, as shown in FIG. 1, by mounting the contact electrode 3 on the seat 2*d* of the slide member 2, then inserting said slide member 2 in the guide walls 1*a* of the upper casing 1 and fixing the printed circuit board 4 on the lower face of the upper casing 1. FIGS. 2 and 3 show the slide switch mechanism in such assembled state in plan views. wherein the ceiling portion inside the guide walls is omitted for the purpose of clarity. FIG. 2 shows a state of using said switch mechanism for 2-position function, whereas FIG. 3 shows a state of using said switch mechanism for 3-position function, in which the slide member 2, the same as that shown in FIG. 2, is positioned in reverse in the guide walls 1*a*. As shown in FIG. 2, the center of width l of the base portion of the slide member 2 coincides with the center of width m of the knob 2*a*. Also the center of internal width l' of the guide walls 1*a* coincides with the center of width m' of the aperture 1*d* represented by the double-dotted chain line for exposing the knob 2*a*. As explained in the foregoing, said width dimensions are so selected as to satisfy the relations l'> but ≅l and m'> but ≅m so that the slide member 2 is rendered freely slidable within the guide walls 1*a*. The center of length q of the base portion of the slide member 2 coincides with the center of length o of the knob portion 2*a*, and the semi-circular projection 2*c* is positioned also on said center. The guide walls 1*a* have an internal length q+r, where q is the length of the base portion of the slide member 2 and r is the stroke thereof. Recesses 1*b*, 1*b*' for 2-position function are mutually spaced by a distance equal to said stroke r, and the center of length of the guide walls 1*a* coincides with the center of the length r between said recesses 1*b*, 1*b*' and with the center of length p of the aforementioned aperture 1*d*. The length o of the knob portion 2*a* and the length p of said aperture 1*d* are so selected as to satisfy the following relations p> but ≅(o+r). In a state shown in FIG. 2, where the semi-circular projection 2*c* of the slide member 2 engages with the recess 1*b* for 2-position function, the end portions 3*b*, 3*c* of the contact electrode 3 shown in FIG. 1 are maintained respectively in contact with circuit patterns 4*a*, 4*b* formed on the printed circuit board 4, thereby forming an electric connection between said patterns 4*a* and 4*b* through said contact electrode 3.

When the slide member 2 is pushed with a finger in a direction indicated by an arrow in FIG. 2 from the position shown therein, the arched spring 2is elastically deformed whereby the semi-circular projection 2*c* is disengaged from said recess 1*b* and becomes engaged with the other recess 1b' *for* 2-position function, passing through the gap between said recesses. In the above-mentioned displacement of the slide member, the resistance is temporarily increased to cause an appropriate click feeling in the switching action. Upon engagement of the semi-circular projection 2c with the recess 1b' after displacement of the slide member 2 over the stroke r, the displacement is terminated by the impingement of the base portion of the slide member 2 with a guide wall and the contact electrode 3 shown in FIG. 1 forms an electric connection between the circuit patterns 4a and 4c instead of the patterns 4a and 4b.

In case the above-explained slide switch mechanism is used for 3-position function, the slide member 2 is inserted in reverse in the guide walls 1a as shown in FIG. 3. As explained in the foregoing, the knob portion 2a of a dimension m×o of the slide member 2 is positioned at the center of the base portion of a dimension l×q and the slide member is structured symmetrically with respect to the center both in the longitudinal and transversal directions, so that the position of the knob portion 2a in FIG. 3 is identical with that in FIG. 2. Recesses 1c, 1c' and 1c'' mutually spaced by a distance r/2 are provided to perform 3-position switching function with a stroke r/2 in cooperation with circuit patterns appropriately positioned on the printed circuit board.

By selecting the length p of the aperture 1d in the upper casing 1, the stroke r and the length q of the base portion of the slide member in such a manner as to satisfy a relation $(q-r)>p$, said aperture 1d is always covered to prevent the printed circuit board from the exposure to the outside regardless of the position of the slide member 2, thereby preventing the intrusion of dusts to ensure satisfactory electrical contact and neat appearance of the switch.

Figure 4:
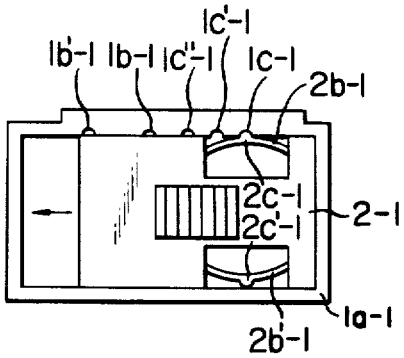
FIGS. 4 and 5 are schematic views of other embodiments.
Figure 5:
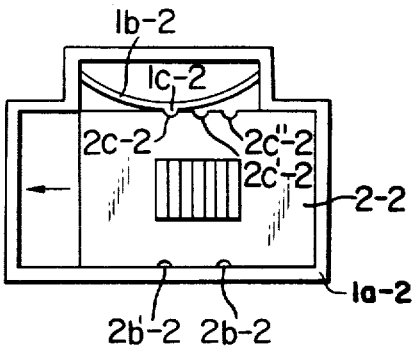

FIGS. 4 and 5 show other embodiments of the present invention. In the embodiment shown in FIG. 4, the recesses 1b-1, 1b'-1 for 2-position function and the recesses 1c-1, 1c'-1, 1c''-1 for 3-position function are both formed on a single guide wall 1a-1 to constitute the first engaging portion, while the slide member 2-1 is provided, as the second engaging portion, with arch-shaped springs 2b-1, 2b'-1, respectively having semi-circular projections 2c-1, 2c'-1.

In the embodiment shown in FIG. 5, an arch-shaped spring 1b-2 having a semi-circular projection 1c-2 and constituting the first engaging portion is provided on a guide wall 1a, while the slide member 2-2 is provided with recesses 2b-2, 2b'-2 for 2-position function and recesses 2c-2, 2c'-2, 2c''-2 for 3-position function both constituting the second engaging portion.

Although the foregoing explanation has been limited to a mechanism capable of 2- and 3-position functions, it will be understood that the number of positions and the switch stroke are not limited by the foregoing embodiments but are arbitrarily selectable.

As explained in the foregoing, the slide switch mechanism of the present invention, capable of modifying the number of positions and/or the switch stroke by the method of assembling without changing the component parts, can provide plural switches different in the number of positions or in the switch stroke from a same guide member and a same slide member, thereby allowing reduction of the manufacturing cost.

I claim:

1. A slide switch mechanism comprising:

a guide member;

a slide member for switching electrical contacts, said slide member being reversibly mountable in said guide member for slidable movement therein;

first engaging means provided in different patterns on two mutually opposed faces of said guide member; and second engaging means provided on a face of said slide member in sliding contact with said guide member to elastically engage with said first engaging means, wherein when said slide member is fitted in said guide member in one manner, said slide member stops at a position different from the stopping position of the slide member when fitted in said guide member in the reverse manner.

2. A slide switch mechanism according to claim 1, wherein said first engaging means is contoured to define plural recesses on said guide member and said second engaging means includes an elastic projection on said slide member.

3. A slide switch mechanism comprising:

a guide member;

a slide member for switching electrical contacts, said slide member being reversibly mountable in said guide member for slidable movement therein;

first engaging means provided asymmetrically on two mutually opposed faces of said slide member; and second engaging means provided on a face of said guide member in sliding contact with said slide member to elastically engage with said first engaging means, wherein when said slide member is fitted in said guide member in one manner, said slide member stops at a position different from the stopping position of the slide member when fitted in said guide member in the reverse manner.

4. A slide switch mechanism according to claim 1 or 3, wherein said slide member is provided on a face thereof with an elastic electrode member for forming electrical contacts with conductive circuit patterns and for pressing the opposite face of said slide member against said guide member.

5. A slide switch mechanism according to claim 4, wherein said first engaging means includes plural elastic projections on said slide member and said second engaging means is contoured to define two different patterns of plural recesses on said guide member.

6. A slide switch mechanism according to claim 4, wherein said first engaging means is contoured to define plural recesses in two different patterns on said slide member and said second engaging means includes an elastic projection on said guide member.

* * * * *